United States Patent [19]

Siero

[11] Patent Number: 4,917,039

[45] Date of Patent: Apr. 17, 1990

[54] BOAT BOW HARNESS

[76] Inventor: Joseph C. Siero, 19608 Meler, Roseville, Mich. 48066

[21] Appl. No.: 255,850

[22] Filed: Oct. 11, 1988

[51] Int. Cl.[4] ..... B63B 21/00

[52] U.S. Cl. ..... 114/230; 441/3

[58] Field of Search ..... 114/230; 441/3, 4, 5

[56] References Cited

U.S. PATENT DOCUMENTS

| | | | |
|---|---|---|---|
| 1,828,821 | 10/1931 | Short et al. | 114/230 |
| 2,411,382 | 11/1946 | Martin | 114/230 |
| 3,060,885 | 10/1962 | Nolf | 114/230 |
| 3,763,816 | 10/1973 | Wilson | 114/230 |
| 3,783,816 | 1/1974 | deChassy et al. | 441/3 |
| 3,938,462 | 2/1976 | Brandt | 114/230 |
| 4,022,450 | 5/1977 | Smith | 114/230 |

FOREIGN PATENT DOCUMENTS

| | | | |
|---|---|---|---|
| 498541 | 9/1954 | Italy | 114/230 |
| 118490 | 7/1983 | Japan | 114/230 |

*Primary Examiner*—Sherman D. Basinger
*Assistant Examiner*—Thomas J. Brahan
*Attorney, Agent, or Firm*—Brooks & Kushman

[57] ABSTRACT

A harness for aligning and protecting the bow of a boat during docking. A starboard, port and fore line are joined at a junction point and connected to three spaced mooring points. Upper and lower starboard and port lines are flexibly interconnected. A spring biasing member is connected to the fore line for biasing the junction point of the port and starboard lines toward the fore line. Flexible tubing sections sheath the upper and lower lines adjacent the junction point. The fore, starboard and port lines are wrapped about their respective mooring points and secured by plastic clamps.

14 Claims, 2 Drawing Sheets

BOAT BOW HARNESS

BACKGROUND OF THE INVENTION

1. Technical Field

This invention relates to a harness which engages the fore end of a boat below the gunwale for docking.

2. Description of the Prior Art

Slips for docking boats are generally provided with pilings to which lines are tied to secure the boat within the slip. When docking, the boat must be carefully maneuvered into the slip and engines reversed to avoid colliding with the sides or end of the slip.

While experienced boaters usually can dock a boat in a slip without problem if a boater is not careful, serious damage to the boat or the dock may occur if the sides of the slip or endwall contact the boat.

The ideal connection between a boat and a slip is a flexible line which permits movement of the boat relative to the slip in controlled amounts as required to accommodate wave action. Bumpers attached to the dock or boat must be properly located to be effective and require frequent adjustment.

These and other problems encountered by the prior art are addressed by the invention as described below.

SUMMARY OF THE INVENTION

According to the present invention, a boat harness for guiding and guarding a boat bow when docking in a slip having fore, port and starboard mooring points is described. A port line is connected to the port mooring point, a starboard line is connected to the starboard mooring point and the port line at a junction point. A fore line connects the junction point to the fore mooring point and holds the port line and starboard line in a generally V-shaped configuration into which a boat may be guided for docking. The port and starboard lines center the boat bow relative to the junction point and hold it away from the sides of the slip.

According to another aspect of the present invention, lower port and starboard lines are similarly interconnected at a lower junction point. The lower port and starboard lines engage the boat bow at a location spaced from and below the port line and starboard line. The lower port and starboard lines function to spread the force of contact by the boat. The force of contact may also be spread by providing a flexible interconnection between the port and starboard lines and the lower port and starboard lines. The flexible member may consist of a plurality of lines extending transversely relative to the upper and lower port and starboard lines.

The port and starboard lines may be formed in a single integral piece, and the lower port and lower starboard lines may also be formed in a single piece.

A tubular sheath is preferably provided on both the upper line and the lower line at the junction point and lower junction point to protect the lines from wear.

The fore line preferably includes means for biasing the junction point toward the fore mooring point such as an elastic or spring member. The biasing means as well serves to support the port and starboard line above water level forward of the port and starboard mooring points. The spring may be a helical spring which is connected at its opposed ends to knotted spaced points on the fore line. Alternatively, the fore line may be formed in whole or in part by an elongated elastic segment which provides the desired biasing and supporting functions.

These and other objects and advantages of the invention will become more apparent upon review of the attached drawings in light of the detailed description of the drawings below.

DETAILED DESCRIPTION OF THE PREFERRED EMBODIMENTS

Figure 1:
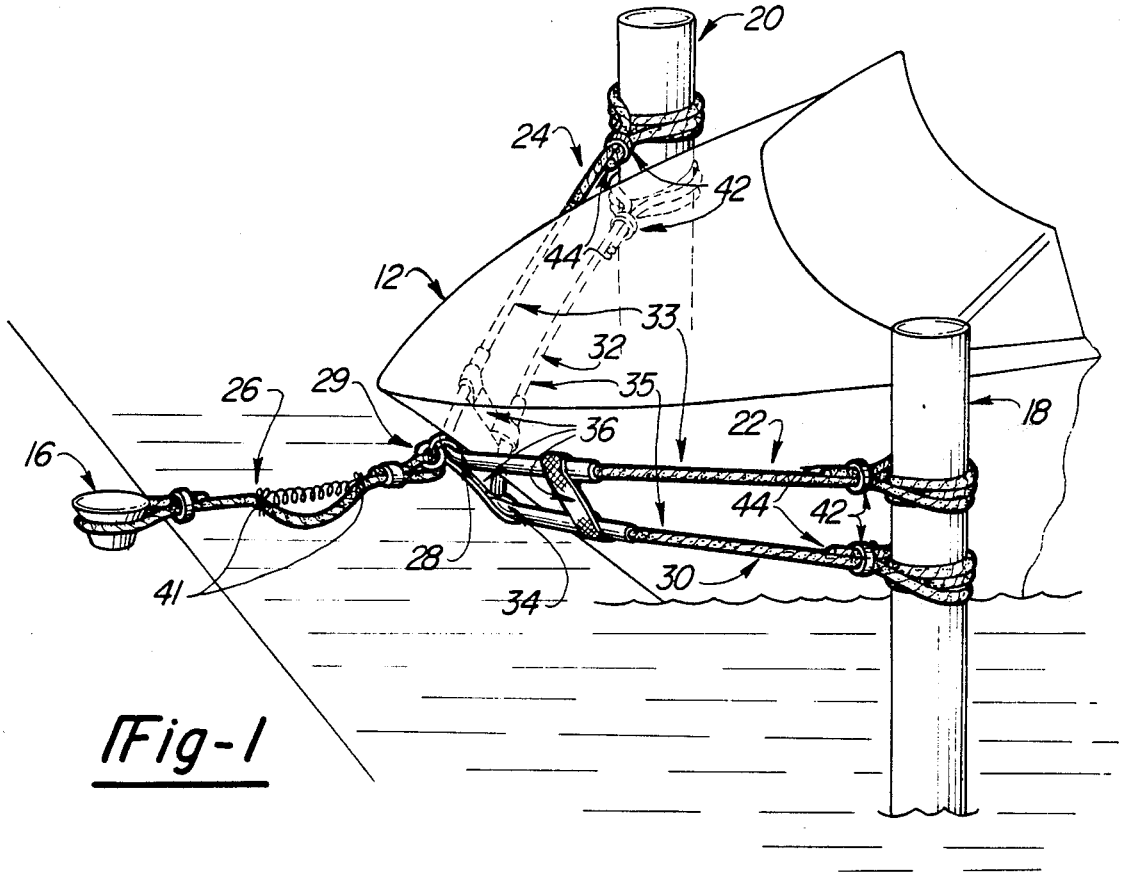
FIG. 1 is a fragmentary perspective view of a boat with its bow engaging a boat harness of the present invention.
Figure 2:
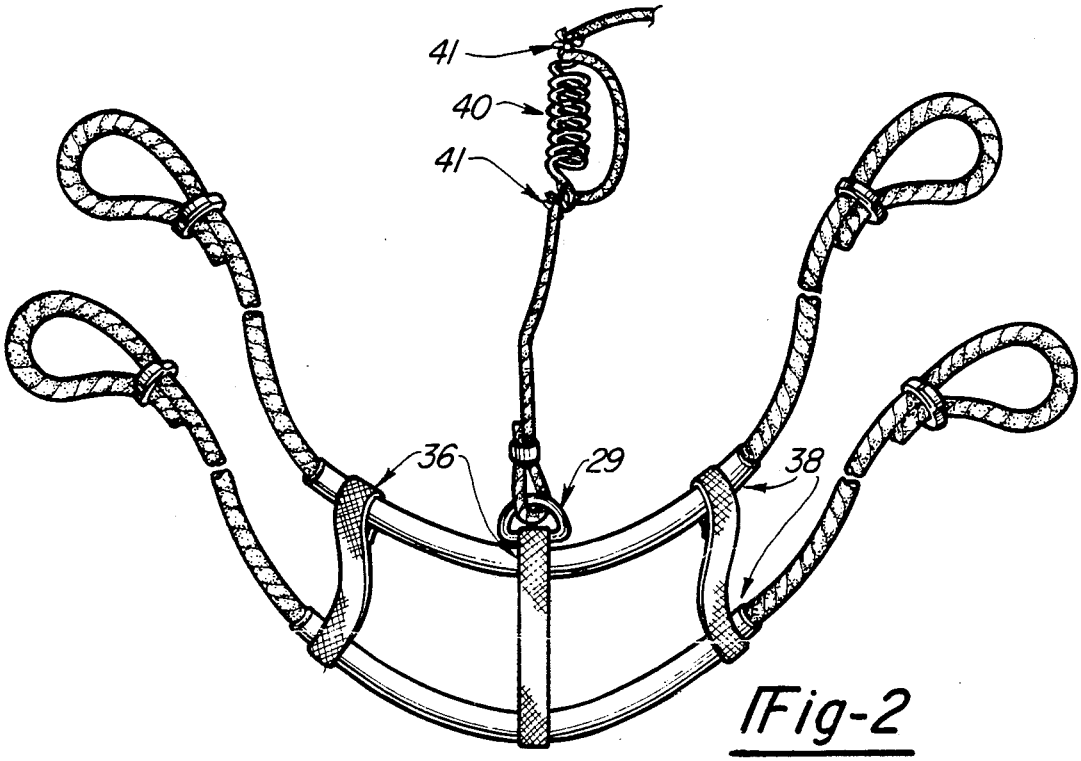
FIG. 2 is a plan view of the boat harness shown in FIG. 1 disassembled from the mooring points.

Referring now to FIGS. 1 and 2, the boat harness 10 of the present invention is illustrated. In FIG. 1, a boat 12 is shown docked in a slip 14 with the boat harness 10 of the present invention deployed.

The slip 14 may be an open slip as illustrated or could include one or more side walkways on the starboard and/or port side of the boat.

As used herein, the terms "fore", "port" and "starboard" are to be understood as to referring to the normal meaning of those terms as applied to the boat 12 docked in the slip 14.

The slip 14 is defined by a fore mooring point 16, port mooring point 18, and a starboard mooring point 20. On the port side of the boat 12, a port line 22 is tied to the port mooring point 18. A starboard line 24 on the starboard side of the boat 12 is secured to the starboard mooring point 20. A fore line 26 extends forwardly from the prow of the boat 12 and is secured to the fore mooring point 16. The port line 22, starboard line 24 and fore line 26 are joined at a junction point 28 and form a generally Y-shaped configuration with the "V" portion of the "Y" being made up of the port line 22 and the starboard line 24

Lower port line 30 and lower starboard line 32 are joined at a lower junction point 34 and hang below the port line 22 and starboard line 24.

In the preferred embodiment, the port line 22 and starboard line 24 form a continuous upper line 33 formed of one length of rope or strapping, and the lower port line 30 and lower starboard line 32 similarly form a continuous lower line 35 of one length of rope or strapping. The lower port line 30 and lower starboard line 32 are connected to the port line 22 and starboard line 24 by one or more flexible members such as a strap 36. An odd numbered plurality of straps 36 are preferably secured about the lower line 35 and the upper line 33. One of the straps 36 extends between the junction points 28,34. The other straps 36 are equally spaced along the upper and lower lines 33,35 between the port and starboard mooring points 18,20.

A ring 29 is preferably provided at the junction point 28. Ring 29 is connected by a strap 36 to junction point 28 and to the end of the fore line 26 opposite the fore mooring point 16.

The lower port and starboard lines 30 and 32 are preferably shorter than the port and starboard lines 22 and 24 so that they, and the lower junction point 34, are slightly aft of the junction point 28. As shown in FIG. 1, this accommodates the conventional bow shape below the gunwale which slopes rearwardly from the fore point to the keel. Ideally, the junction point 28 and lower junction point 34 would be contacted substantially simultaneously by the bow. If one line is contacted first it will tend to stretch until the second line is engaged. The dual line is intended to spread the force of the bow engaging the lines and add strength to the harness.

Tubular sheaths 38 which are lengths of flexible tubing are placed on the lines 22, 24, 30, 32 at the junction point 28 and the lower junction point 34. The tubing prevents frictional wear of the lines 22,24,30,32 caused by engagement with the boat 12. The tubular sheaths 38 may be replaced periodically.

The fore line 26 preferably biases the junction point 28 toward the fore mooring point 16. Means for biasing the junction point 28 may include a helical spring 40 connected to two knotted spaced points 41 on the fore line as shown in FIGS. 1 and 2. The helical spring 40 pulls the junction point 28 toward the fore mooring point and consequently holds the lines 22,24,30,32 in a substantially horizontally array above and substantially parallel to the water line. As the lines 22,24,30,32 stretch over time they can be periodically re-wrapped and secured to the mooring points 18,20. The helical spring 40 is intended to take up slack between adjustments.

Figure 4:
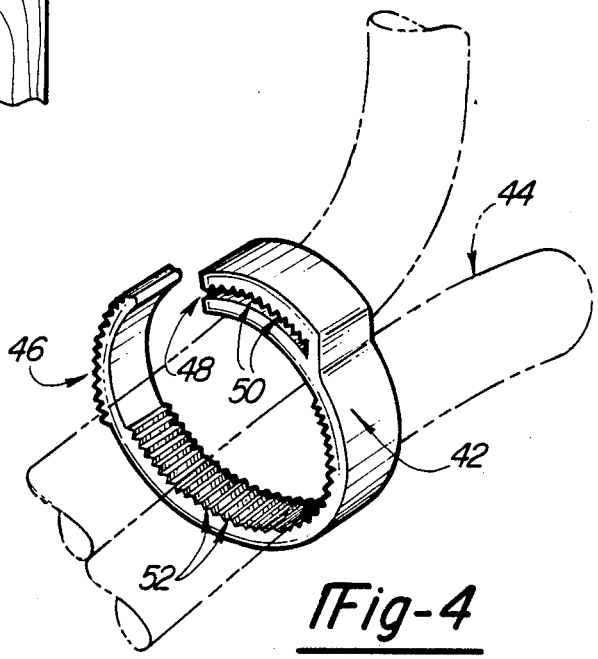
FIG. 4 is a perspective view of a line clamp used for securing one of the lines to a mooring point.

Referring now to FIG. 4, a line clamp 42 is shown in detail. Line clamps 42 are shown attached to the boat harness 10 in FIGS. 1 and 2. The line clamp 42 secures a terminal end 44 of each of the lines 22,24,30,32 back to the line 22,24,30,32 after being wound about the mooring points several times. The line clamp 42 includes a tongue 46 which is received in a groove 48. The tongue 46 and groove 48 include cooperating complementary ridges 50 which hold the line clamp 42 together. Gripping ribs 52 are formed on the inner diameter of the line clamp 42.

Figure 3:
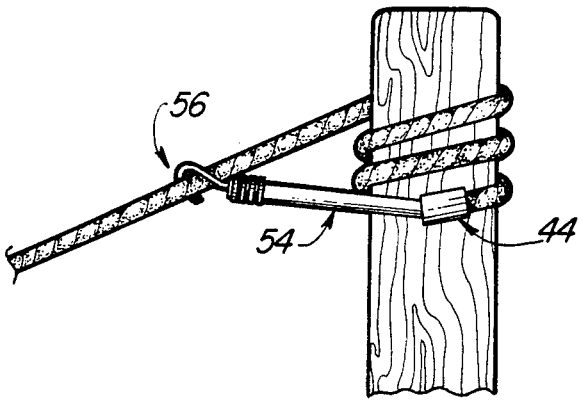
FIG. 3 is a fragmentary side elevational view of one line of the boat harness connected to a mooring point.

Referring now to FIG. 3, the line may be secured to the mooring points by attachment to the terminal end 44 of each line 22,24,30,32 of an elastic cord 54 having a hook 56 which engages the line 22,24,30,32.

Figure 5:
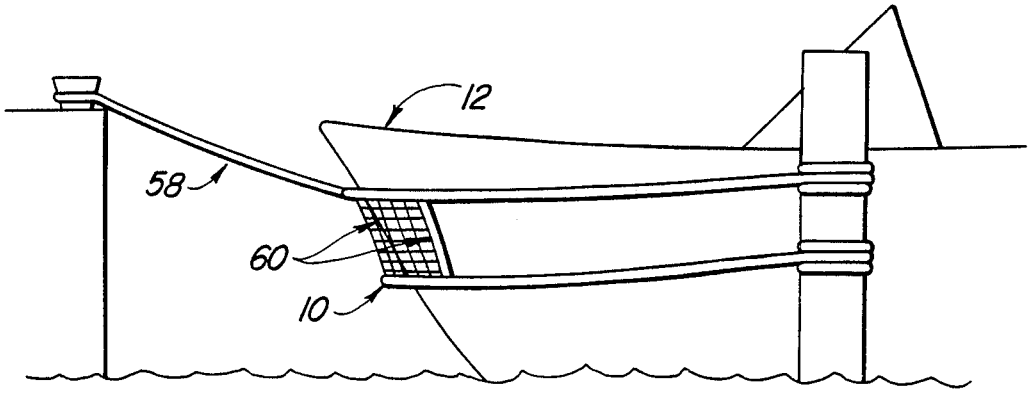
FIG. 5 is a side elevational view of an alternative embodiment of the boat harness of the invention.

Referring now to FIG. 5, an alternative embodiment of the boat harness 10 is shown wherein an elastic fore line 58 is provided. The elastic fore line 58 would take the place of the fore line 26 and would eliminate the need for the helical spring 40. The upper and lower lines 33,35 are shown interconnected by a woven series of lines 60 which provide a broader area of contact with the boat 12.

After the boat is maneuvered into the boat harness 10 it can be tied off in the slip 14 with conventional lines both fore and aft. The boat harness 10 serves to center the fore end of the boat 12 in the slip 14.

It will be readily appreciated that the boat harness 10 of the present invention is easy to install in a slip and greatly simplifies docking a boat 12 in a slip 14 because the fore end of the boat 12 is automatically centered by the boat harness 10. The flexibility of the lines 22,24,30,32 permits limited movement of the boat 12 caused by wave action.

It will be readily appreciated that many modifications and variations of the boat harness of the present invention may be made without departing from the scope and spirit of the invention as defined by the following claims.

What is claimed is:

1. A boat harness apparatus for facilitating docking of a boat in a slip having a single fore mooring point fixed to a dock, a port mooring point and a starboard mooring point comprising:

a port line of fixed length connected to the port mooring point;

a lower port line of fixed length connected to the port mooring point;

a starboard line of fixed length connected to the starboard mooring point and said port side line;

a lower starboard line of fixed length connected to the starboard mooring point and the lower port line, at a lower junction point, said lower port line and said lower starboard line being connected to the port line and the starboard line by a flexible member; and a fore line connected to the fore mooring point and a junction point formed at the interconnection between the port line, starboard line and fore line, whereby the boat may be docked by entering the harness apparatus between the port line and the starboard line which center the boat bow relative to the junction point.

2. In the boat harness of claim 1, means provided on each of said port line, starboard line, and fore line adjacent said port mooring point, starboard mooring point, and fore mooring point for tying said lines about said mooring points wherein said lines may be set at different fixed lengths.

3. The boat harness of claim 1 wherein said flexible member is a plurality of lines extending vertically between the port and starboard lines and the lower port and starboard lines.

4. In the boat harness of claim 3, a ring being secured to said fore line and one of said plurality of vertically extending lines.

5. The boat harness of claim 1 wherein said port line and said starboard line together form an upper line, and said lower port line and said lower starboard line together form a lower line.

6. In the boat harness of claim 5, a pair of tubular sheaths being disposed on said upper line and said lower line at said junction point and lower junction point, respectively.

7. A boat harness apparatus for facilitating docking of a boat in a slip having a single fore mooring point fixed to a dock, a port mooring point and a starboard mooring point comprising:

a port line of fixed length connected to the port mooring point;

a starboard line of fixed length connected to the starboard mooring point and said port side line;

a fore line connected to the fore mooring point and a junction point formed at the interconnection between the port line, starboard line and fore line, whereby the boat may be docked by entering the harness apparatus between the port line and the starboard line which center the boat bow relative to the junction point; and a helical spring connected on its opposed ends to spaced points on said fore line for biasing said junction point toward said fore mooring point and for supporting said port line and starboard line above water and forward of the port and starboard mooring points.

8. A boat harness apparatus for facilitating docking of a boat in a slip having a single fore mooring point fixed to a dock, a port mooring point and a starboard mooring point comprising:

a port line of fixed length connected to the port mooring point;

a starboard line of fixed length connected to the starboard mooring point and said port side line;

a fore line connected to the fore mooring point and a junction point formed at the interconnection between the port line, starboard line and fore line, whereby the boat may be docked by entering the harness apparatus between the port line and the starboard line which center the boat bow relative to the junction point; and a spring extending at least partially between said fore mooring point and said junction point for biasing said junction point toward said fore mooring point and for supporting said port line and starboard line above water and forward of the port and starboard mooring points.

9. A boat bow harness, which comprises:

an upper line;

a fore line connected to an intermediate point on the upper line and retaining the upper line in a V-shape and generally parallel to the water;

a lower line retained in a V-shape substantially parallel to the upper line;

said upper lines's opposite ends being connected to two mooring points on opposite sides of a rectangular slip such that the vertex of the V-shape is positioned at a point fore of the two mooring points, and such that the bisection of said V-shape forming a centerline of said slip is perpendicular to the plane of the end of the slip;

said lower line's opposite ends being connected to said two mooring points such that the vertex of lower line's V-shape is a shorter distance fore of the two mooring points than the upper line vertex, the top and bottom vertices approximating the angle defined by the sloping line of the end of the bow of said boat docked in the slip;

each end of the upper and lower lines being attached to said two mooring points, wherein said lines are affixed on the two mooring points at such a height above the water to enable the lines to engage the boat below the gunwale of the boat;

a fore line being affixed to a fore mooring point and the upper line vertex, which vertex being said intermediate point, said fore line anchoring said harness to the end of the slip and suspending said harness over the water between said fore mooring point and said two mooring points; and a pair of plastic sleeves through which said upper and lower lines are threaded, being disposed adjacent to and extending in each direction away from the upper and lower vertex to a point at which said boat would not generally engage the lines, whereby said sleeves retard fraying of the lines.

10. The harness of claim 9, wherein top and bottom lines are interconnected by an odd numbered plurality of linking lines, each with top and bottom ends, wherein the length of each linking line is approximately equal to the distance said top and bottom lines are apart when attached to said two mooring points and wherein the first end of one linking line is attached to said upper line vertex, and said second end is attached to said lower line vertex, such that said vertex linking line is substantially vertical, the other of said linking lines being attached to said upper and lower lines at spaced intervals along said upper and lower lines.

11. The harness of claim 10, wherein the lines are marine rope.

12. The harness of claim 10, wherein the lines are of marine cable.

13. The harness of claim 9, wherein said upper and lower lines are attached by an elongated rectangular lattice, a centerline of the lattice coinciding with the upper and lower line vertices, said lattice extending along said upper and lower lines in each direction to a point at which said boat would not generally engage the lines.

14. A boat harness apparatus for facilitating docking of a boat in a slip having a fore mooring point, a port mooring point and a starboard mooring point comprising:

a port line connected to the port mooring point;

a starboard line connected to the starboard mooring point and said port side line;

a fore line connected to the fore mooring point and a junction point formed at the interconnection between the port line, starboard line and fore line, whereby the boat may be docked by entering the harness apparatus between the port line and the starboard line which center the boat bow relative to the junction point;

a lower port line connected to the port mooring point and a lower starboard line connected to the starboard mooring point, and the lower port line, at a lower junction point, said lower port line and said lower starboard line being connected to the port line and the starboard line by a plurality of lines extending transversely relative to the port and starboard lines and the lower port and starboard lines;

said port line and said starboard line together form an upper line, and said lower port line and said lower starboard line together form a lower line;

a pair of tubular sheaths being disposed on said upper line and said lower line at said junction point and lower junction point, respectively;

a helical spring connected on its opposed ends to spaced points on said fore line, said spring biasing said junction point toward said fore mooring point and for supporting said port line and starboard line above water and forward of the port and starboard mooring points; and means provided on each of said port line, starboard line, and fore line adjacent said port mooring point, starboard mooring point, and fore mooring point for adjustably tying said lines about said mooring points.

* * * * *